US011910856B2

(12) United States Patent
Dickson et al.

(10) Patent No.: US 11,910,856 B2
(45) Date of Patent: Feb. 27, 2024

(54) GARMENT FOR UPRIGHT SLEEPING

(71) Applicant: NIKE, Inc., Beaverton, OR (US)

(72) Inventors: Gregory Dickson, Beaverton, OR (US); Tobie D. Hatfield, Lake Oswego, OR (US); Hee Ji, Beaverton, OR (US); Daniel A. Judelson, Portland, OR (US); Peter P. Williams, II, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 20 days.

(21) Appl. No.: 17/338,946

(22) Filed: Jun. 4, 2021

(65) Prior Publication Data

US 2022/0015465 A1 Jan. 20, 2022

Related U.S. Application Data

(60) Provisional application No. 63/051,634, filed on Jul. 14, 2020.

(51) Int. Cl.
*A41D 3/02* (2006.01)

(52) U.S. Cl.
CPC ..... *A41D 3/02* (2013.01); *A41D 2200/20* (2013.01)

(58) Field of Classification Search
CPC ... A41D 3/00; A41D 3/02; A41D 1/02; A41D 15/00; A41D 3/04; A41D 3/005; A41D 2200/20

(Continued)

(56) References Cited

U.S. PATENT DOCUMENTS 2,368,654 A * 2/1945 Frank ..... A41D 3/00 2/84
5,560,043 A * 10/1996 Armstrong ..... A41D 3/00 2/85

(Continued)

FOREIGN PATENT DOCUMENTS

| | | | |
|---|---|---|---|
| CN | 106413448 | B | 10/2018 |
| EP | 3405055 | B1 | 12/2019 |
| WO | 2018/222459 | A1 | 12/2018 |

OTHER PUBLICATIONS

International Search Report and Written Opinion received for PCT Patent Application No. PCT/US2021/036602, dated Oct. 1, 2021, 17 pages.

(Continued)

*Primary Examiner* — Jameson D Collier
(74) *Attorney, Agent, or Firm* — Shook, Hardy & Bacon L.L.P.

(57) ABSTRACT

Aspects herein are directed to an upper-body garment that facilitates upright sleeping. The garment includes an inner hood with a mesh elastic panel that is adapted to be positioned across the wearer's forehead helping to anchor the inner hood on to the wearer's head. The inner hood includes a low stretch or no stretch center panel. The center panel extends from the mesh elastic panel, down the center back of the inner hood, and further extends on to a back aspect of a torso portion of the garment where it forms a center portion of the back of the upper-body garment. Because the center panel has low stretch or no stretch, the wearer's head and neck are held in an upright or generally upright position when the inner hood is donned. The upper-body garment further includes a large volume outer hood positioned external to the inner hood.

16 Claims, 9 Drawing Sheets

(58) Field of Classification Search
USPC ..... 2/84
See application file for complete search history.

(56) References Cited

U.S. PATENT DOCUMENTS

| | | | | |
|---|---|---|---|---|
| 6,665,878 | B1 * | 12/2003 | Way | A41D 3/02 2/84 |
| 2004/0187186 | A1 * | 9/2004 | Boezi | A41D 15/005 2/84 |
| 2005/0160514 | A1 * | 7/2005 | Flaniken | A41D 3/005 2/84 |
| 2006/0288465 | A1 * | 12/2006 | Delorenzo | A41D 3/005 2/84 |
| 2007/0118960 | A1 | 5/2007 | Goodwin | |
| 2014/0096305 | A1 * | 4/2014 | Friesen | A41D 15/04 2/84 |
| 2016/0374415 | A1 * | 12/2016 | Chang | A41D 15/00 2/69 |
| 2018/0343950 | A1 * | 12/2018 | Brandt | A41D 3/02 |
| 2019/0059462 | A1 * | 2/2019 | Grogro | A41D 13/0007 |
| 2019/0174853 | A1 * | 6/2019 | Rickle | A42B 1/048 |

OTHER PUBLICATIONS

International Preliminary Report on Patentability received for PCT Patent Application No. PCT/US2021/036602, dated Jan. 26, 2023, 11 pages.

* cited by examiner

GARMENT FOR UPRIGHT SLEEPING

CROSS-REFERENCE TO RELATED APPLICATIONS

This application having U.S. application Ser. No. 17/338,946 filed Jun. 4, 2021 and titled "Garment for Upright Sleeping," claims the benefit of priority of U.S. App. No. 63/051,634, filed Jul. 14, 2020, and titled "Garment for Upright Sleeping." The entirety of the aforementioned application is incorporated by reference herein.

TECHNICAL FIELD

Aspects herein relate to an upper-torso garment that facilitates upright sleeping.

BACKGROUND

Traditional articles used to facilitate upright sleeping when, for example, flying or riding in a car or bus, generally take the form of padded, horseshoe-shaped collars that a wearer can position around their neck, straps that wrap around a seat and a wearer's forehead, or soft blocks that a wearer can rest their head on. These articles are generally uncomfortable, have limited utility outside the context of upright sleeping, and require the user to transport the article when not in use.

SUMMARY

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1. An upper-body garment comprising: a torso portion defining a neck opening and a waist opening, the torso portion having a front aspect and a back aspect; an outer hood affixed to the neck opening at both a first end and a second end of an unaffixed portion of the outer hood to form an opening, wherein the opening is located at the back aspect of the torso portion; and an inner hood positioned internal to the outer hood, a center panel portion of the inner hood affixed to the outer hood at the first end and the second end of the unaffixed portion of the outer hood, the center panel portion of the inner hood further affixed to a top of the outer hood.

Clause 2. The upper-body garment according to clause 1, wherein the center panel portion of the inner hood extends through the opening and forms at least a portion of the back aspect of the torso portion.

Clause 3. The upper-body garment according to any of clauses 1 through 2, wherein the center panel portion is formed from a low stretch or no stretch material.

Clause 4. The upper-body garment according to any of clauses 1 through 3, wherein the center panel portion includes a low stretch or no stretch film material affixed to a first surface of the center panel portion.

Clause 5. The upper-body garment according to any of clauses 1 through 4, wherein the center panel portion of the inner hood is affixed to the top of the outer hood at a location that is spaced posteriorly from a hood opening edge of the outer hood.

Clause 6. The upper-body garment according to any of clauses 1 through 5, wherein the inner hood further includes a right panel piece and a left panel piece, each of the right panel piece and the left panel piece having a medial edge, a lateral edge, and a lower edge.

Clause 7. The upper-body garment according to clause 6, wherein the medial edge of each of the right panel piece and the left panel piece are affixed to the center panel portion.

Clause 8. The upper-body garment according to any of clauses 6 through 7, wherein the lateral edge of the each of the right panel piece and the left panel piece are substantially unaffixed from the outer hood.

Clause 9. The upper-body garment according to any of clauses 6 through 8, wherein the lower edge of the each of the right panel piece and the left panel piece are unaffixed from the neck opening of the torso portion.

Clause 10. An upper-body garment comprising: a torso portion defining a neck opening and a waist opening, the torso portion having a front aspect and a back aspect, wherein the back aspect includes a center panel portion; an outer hood continuously affixed to the neck opening except for a first location at the back aspect of the torso portion to form an opening; and an inner hood positioned internal to the outer hood, wherein the center panel portion of the back aspect of the torso portion extends through the opening and forms at least part of the inner hood.

Clause 11. The upper-body garment according to clause 10, wherein the center panel portion is affixed to a first end and a second end of the opening.

Clause 12. The upper-body garment according to any of clauses 10 through 11, wherein the center panel portion is affixed to a top of the outer hood at a location that is spaced posteriorly from a hood opening edge of the outer hood.

Clause 13. The upper-body garment according to clause 12, wherein remaining areas of the center panel portion are unaffixed from the outer hood.

Clause 14. The upper-body garment according to any of clauses 10 through 13, wherein the center panel portion extends to the waist opening of the torso portion.

Clause 15. The upper-body garment according to any of clauses 10 through 14, wherein the inner hood includes a right panel piece and a left panel piece, each of the right panel piece and the left panel piece having a medial edge, a lateral edge, and a lower edge.

Clause 16. The upper-body garment according to clause 15, wherein the medial edge of each of the right panel piece and the left panel piece are affixed to the center panel portion.

Clause 17. The upper-body garment according to any of clauses 15 through 16, wherein the lateral edge of the each of the right panel piece and the left panel piece are substantially unaffixed from the outer hood.

Clause 18. The upper-body garment according to any of clauses 15 through 17, wherein the lower edge of the each of the right panel piece and the left panel piece are unaffixed from the neck opening of the torso portion.

Clause 19. A method of manufacturing an upper-body garment having a torso portion with a neck opening and a waist opening, the method comprising: continuously affixing an outer hood to the neck opening of the torso portion except for a first location at a back aspect of the torso portion to form an opening; positioning an inner hood internal to the outer hood; and affixing a center panel portion of the inner hood to a first end and a second end of the opening and to a top of the outer hood at a location that is spaced posteriorly from a hood opening edge of the outer hood.

Clause 20. The method of manufacturing the upper-body garment having the torso portion with the neck opening and the waist opening according to clause 19, further comprising affixing a low stretch or no stretch film material to a first surface of the center panel portion.

BRIEF DESCRIPTION OF THE DRAWINGS

Examples of aspects herein are described in detail below with reference to the attached drawing figures, wherein.

DETAILED DESCRIPTION

Figure 1:
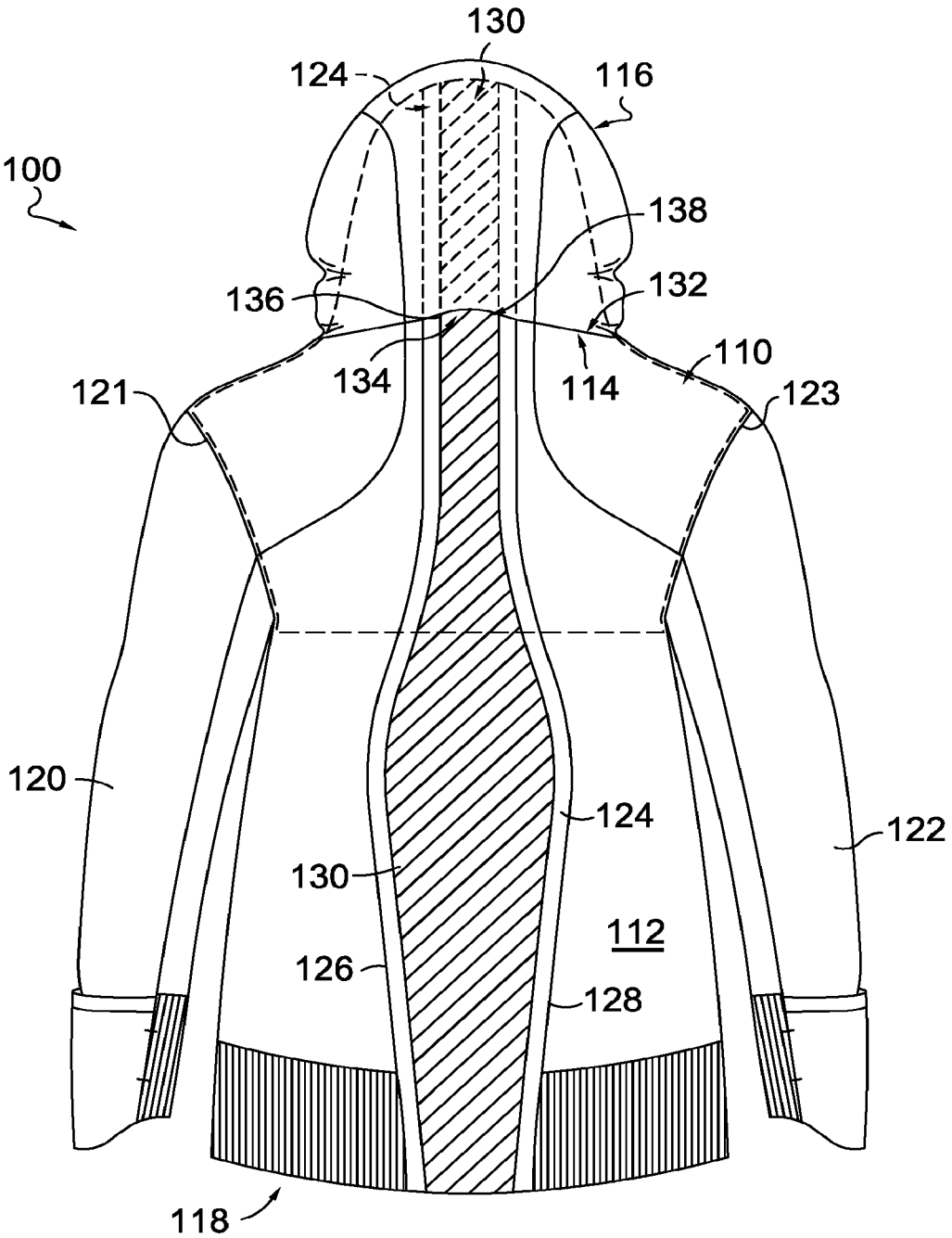
FIG. 1 illustrates a back view of an example upper-body garment for upright sleeping in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Traditional articles used to facilitate upright sleeping when, for example, flying or riding in a car or bus, generally take the form of padded, horseshoe-shaped collars that a wearer can position around their neck, straps that wrap around both a seat and a wearer's forehead and/or chin, or soft blocks that a wearer can rest their head on. These articles are generally uncomfortable, have limited utility outside the context of upright sleeping, and require the user to transport the article when not in use.

Aspects herein are directed to an upper-body garment that facilitates upright sleeping and also functions as a jacket allowing it to be worn as a garment when not used to facilitate upright sleeping. The garment includes an inner hood that fits securely and snugly over and around a wearer's head. The inner hood has a mesh elastic panel that is adapted to be positioned across the wearer's forehead helping to anchor the inner hood on to the wearer's head while still being breathable and comfortable to wear. The inner hood includes a center panel constructed to have low stretch or no stretch. The center panel extends from the mesh elastic panel, down the center back of the inner hood, and further extends on to a back aspect of a torso portion of the garment where it forms a center portion of the back of the upper-body garment. Because the center panel has low stretch or no stretch in response to tensioning forces, the wearer's head and neck are held in an upright (e.g., neutral) or generally upright position when the inner hood is donned.

The garment further includes a large volume outer hood. In example aspects, the outer hood is affixed to a neck opening of the torso portion of the garment except for a first location at the center back of the neck opening through which the center panel of the inner hood extends. In example aspects, the outer hood is constructed from a heavy weight material that provides a sense of security and privacy when the outer hood is worn. The heavy weight material may also help to muffle external sound. The outer hood may include an upper forward extension that can be drawn over the wearer's eyes when the wearer wishes to sleep or rest. Alternatively, the upper forward extension may be folded back when the wearer no longer wishes to sleep or rest.

Because of the size disparity between the inner hood and the outer hood, a lower edge of the inner hood is unaffixed from the neck opening of the torso portion of the garment to avoid unnecessary bunching of the outer hood at this location. An alternative construction for seating or securing the inner hood includes an inner vest having an upper edge that is affixed to the lower edge of the inner hood; the inner vest is positioned interior to the torso portion of the garment. The inner vest is further affixed to armhole openings of the torso portion of the garment and/or to front opening edges of the torso portion. Thus, when the garment is worn and the wearer's arms extend through the armhole openings, the tension placed on the lower edge of the inner hood helps to ensure that the inner hood fits snugly and securely on the wearer's head and prevents the inner hood from riding up.

The garment may include additional features such as a first pocket located on an upper, right front of the garment and a second pocket located on an upper, left front of the garment. When the wearer is sleeping or resting, the wearer can cross their arms and insert, for example, a right hand in the second pocket and a left hand in the first pocket to help maintain the wearer's arms in a crossed position. The garment may also include a mitt that extends from the distal ends of the garment sleeves. The mitt may be positioned or folded over the wearer's hands when additional warmth is desired.

The term "upper-body garment" as used herein is meant to encompass a number of different configurations adapted to cover an upper torso area of a wearer when the upper-body garment is worn. The configurations may include a jacket or coat, a pullover, a hoodie, a vest, and the like. Positional or directional terms used to describe the upper-body garment such as front, back, internal, external, top, upper, lower, center, medial, lateral, anterior, posterior, and the like refer to the garment being worn as intended by a wearer standing upright. Thus, the term "front" means configured to cover a front torso area of a wearer, and the term "back" means configured to cover a back torso area of a wearer. The term "internal" means positioned closer to a body surface of a wearer with respect to another structure or layer. The term "external" means positioned farther away from a body surface of a wearer with respect to another structure or layer. The term "top" when referring to, for example, the inner hood, means positioned generally at the apex or top of a wearer's head. The term "medial" means located closer to a midline of the garment or a wearer wearing the garment, and the term "lateral" means located closer to a side of the garment or a wearer wearing the garment. The term "center" when referring to, for example, the inner hood or the back aspect of the torso portion of the garment means located generally along a vertical midline of the garment or a wearer wearing the garment. The term "anterior" means located closer to the front of the garment or a wearer wearing the garment, and the term "posterior" means located closer to the back of the garment or a wearer wearing the garment.

The term "low stretch" or "no stretch" when referring to the center panel of the inner hood which extends on to the back aspect of the torso portion means exhibiting little to no stretch when subjected to a tensioning force in the x-direction (e.g., the horizontal direction) and the y-direction (e.g., the vertical direction). In example aspects, the low stretch or no stretch material may not include any elastic yarns such as spandex. Unless otherwise noted, all measurements provided herein are measured when the upper-body garment is at standard ambient temperature and pressure (25 degrees Celsius or 298.15 K and 1 bar) and is in a resting (e.g., un-stretched) state.

FIG. 1 depicts a back view of an example upper-body garment 100 that facilitates upright sleeping. The upper-body garment 100 includes a torso portion 110 having a back aspect 112 and a front aspect (shown in FIG. 2). The torso portion 110 include a neck opening 114 from which a large volume outer hood 116 extends. In example aspects, the neck opening 114 is positioned such that it encircles a lower neck area of a wearer when the upper-body garment 100 is worn. The torso portion 110 further includes a waist opening 118 through which a torso area of wearer extends when the garment 100 is worn. The garment 100 may further include a first sleeve 120 which extends from a first sleeve opening 121 of the torso portion 110 and a second sleeve 122 extending from a second sleeve opening 123 of the torso portion 110. Although shown with long sleeves, it is contemplated herein that the upper-body garment 100 may not have sleeves and be in the form of a vest. Alternatively, the first sleeve 120 and the second sleeve 122 may comprise three-quarter sleeves, half sleeves, one-quarter sleeves and the like.

The back aspect 112 of the torso portion 110 includes a center panel 124 that, in example aspects, extends superiorly from the waist opening 118 and forms, at least in part, an inner hood. The portion of the center panel 124 that forms the inner hood is depicted in dashed line to indicate it is hidden from view by the outer hood 116. In an alternative example, the center panel 124 may begin a predetermined distance superior to the waist opening 118 such as, for example, from about 10 cm to about 50 cm superior to the waist opening 118. As used herein, the term "about" means within ±10% of an indicated value. The center panel 124 positioned below the inner hood is adapted to overlie the spine of a wearer when the garment 100 is worn. In example aspects, the center panel 124 is a separate panel piece that is seamed to one or more additional panels that form the back aspect 112 of the torso portion 110 for example, at seam 126 and seam 128. Although the center panel 124 is depicted as having both linear edges and curved edges, it is contemplated herein that the edges of the center panel 124 may be just linear. Additionally, although the center panel 124 is shown as having a greater width in some areas and a lesser width in other areas as it extends from the waist opening 118 on the back aspect 112 of the torso portion 110, it is contemplated herein that the center panel 124 may have a uniform width. It is further contemplated herein that the center panel 124 may form an outermost-facing surface of the garment 100. Any and all aspects, and any variation thereof, are contemplated as being within aspects herein.

In example aspects, the center panel 124 is formed from a textile that exhibits low stretch or no stretch. For example, the center panel 124 may include a tightly woven construction using non-elastic yarns. In one example aspect, the center panel 124 may be woven using, for example, 100% polyester yarns, in a plain twill pattern having from about 100 to about 110 weft yarns per square centimeter and from about 175 to about 185 warp yarns per square centimeter. Using a tightly woven construction, as opposed to a knit construction, limits mechanical stretch due to the packing of the weft and warp yarns at right angles versus the looser nature of knit loops. To further inhibit stretch properties of the center panel 124, a no stretch or low stretch film material 130 shown with hatching may be affixed to the center panel 124. In one example aspect, the film material may comprise Bemis film EX03900P® produced by Bemis Associates, Inc., located at One Bemis Way in Shirley, Massachusetts. In example aspects, the film material 130 may be affixed to an outer-facing surface of the center panel 124 where it may further provide an aesthetic element to the upper-body garment 100. For example, the film material 130 may be a different color, texture, and/or finish from the fabric used to form the upper-body garment 100. It is also contemplated herein that the film material 130 may be affixed to an inner-facing surface of the center panel 124, or to both an inner-facing surface and an outer-facing surface of the center panel 124.

With respect to the outer hood 116, a lower edge 132 of the outer hood 116 is continuously affixed (e.g., by stitching, bonding, and the like) to the neck opening 114 except for a first location positioned at the center of the back aspect 112 of the torso portion 110 to form an opening 134. Stated differently, the outer hood 116 is affixed to the neck opening 114 at both a first end 136 and a second end 138 of an unaffixed portion that forms the opening 134. As explained in further detail below, the center panel 124 extends through the opening 134 and forms part of the inner hood. It is contemplated herein that the outer hood 116 is formed of a medium to heavy weight material (e.g., a fabric having a weight of from about 150 grams per square meter (gsm) or greater) having a soft hand. Use of a heavy weight material for the outer hood 116 provides a sense of security and privacy to a wearer when the outer hood 116 is donned. As well, the heavy weight material may muffle sound which facilitates the wearer resting or sleeping. As mentioned above, in example aspects, the outer hood 116 is configured to have a large volume such that the outer hood 116 does not fit securely or snugly against the wearer's head.

Figure 2:
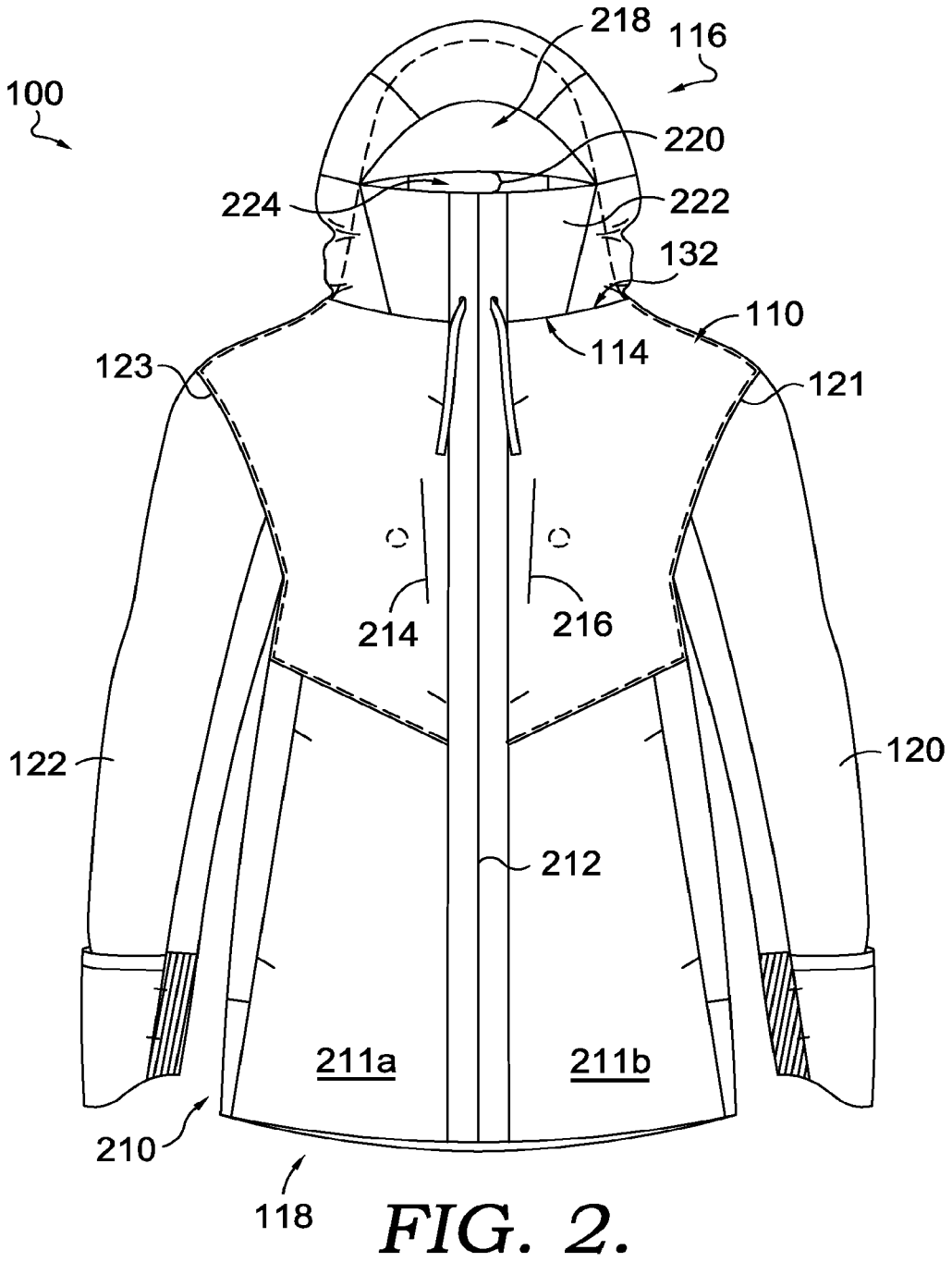
FIG. 2 illustrates a front view of the upper-body garment of FIG. 1 in accordance with aspects herein.

FIG. 2 depicts a view of the front aspect 210 of the torso portion 110 of the upper-body garment 100. The upper-body garment 100 includes a releasable closure mechanism 212, such as a zipper, that can be used to disengage two front panels 211*a* and 211*b* that form the front aspect 210 of the garment 100. The front aspect 210 of the torso portion 110 further includes a first pocket 214 located at an upper, right front of the garment 100 and a second pocket 216 located at an upper, left front of the garment 100. In example aspects, the first pocket 214 and the second pocket 216 may be reversibly closed through a magnetic closure system (shown as a dashed circle) although other closure systems such as snaps, zippers, buttons, and the like are contemplated herein. Use of a magnetic closure system may provide easy access to the first pocket 214 and the second pocket 216 as opposed to, for instance, a zipper system. In example aspects, when a wearer wishes to sleep or rest, the wearer may insert her left hand into the first pocket 214 and her right hand into the second pocket 216 to assume a comfortable, crossed-arm position. It is contemplated herein that the upper-body garment 100 may include additional pockets not shown.

The lower edge 132 of the outer hood 116 is shown affixed to the neck opening 114 of the torso portion 110. In example aspects, the outer hood 116 includes an upper forward extension 218 (better seen in the side view of FIG. 5). The upper forward extension 218 forms at least part of an upper part of a hood opening edge 220 of the outer hood 116. When a wearer wishes to sleep or rest, the wearer can pull the upper forward extension 218 over the wearer's eyes to help block light. In example aspects, the outer hood 116 may include a lower front panel 222 that extends a distance superior to the neck opening 114 at the front of the outer hood 116. An upper edge of the lower front panel 222 further forms a lower part of the hood opening edge 220. When the releasable closure mechanism 212 is fully coupled, the lower front panel 222 cooperates with the upper forward extension 218 to define a small face opening 224. The small face opening 224 limits the amount of light hitting a wearer's eyes which facilitates resting or sleeping.

Figure 3:
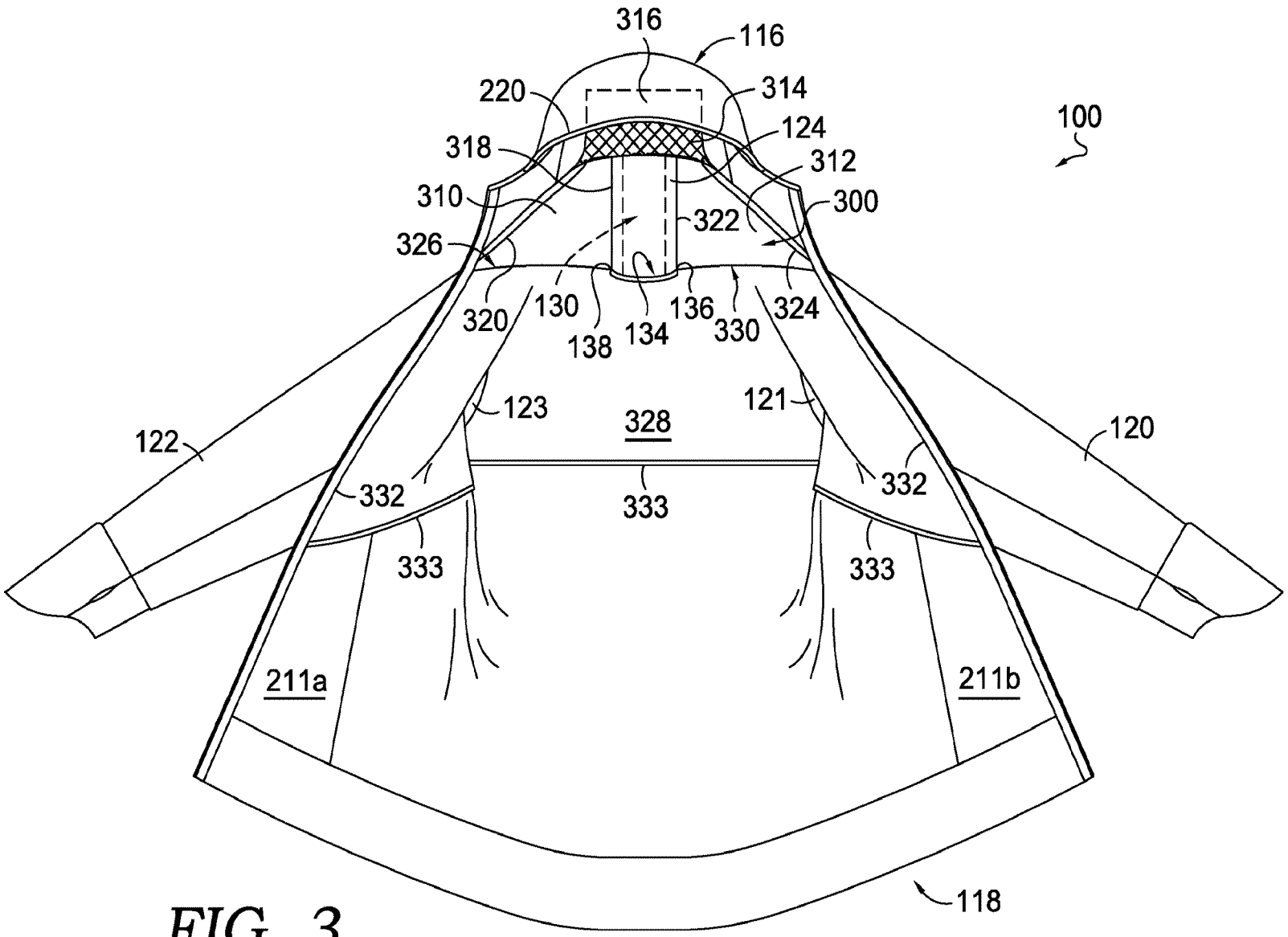
FIG. 3 illustrates a front view of the upper-body garment of FIG. 1 with the garment in an open state such that an interior of the garment is shown in accordance with aspects herein.

FIG. 3 illustrates a front view of the interior of the upper-body garment 100. The upper-body garment 100 includes an inner hood 300 that is positioned internal to the outer hood 116. The inner hood 300 is formed from the center panel 124, a right panel piece 310, a left panel piece 312, and a mesh elastic panel 314. As described above, the center panel 124 forms a central portion of the back aspect 112 of the torso portion 110. The center panel 124 extends through the opening 134 formed where the outer hood 116 is unaffixed from the neck opening 114. After extending through the opening 134, the center panel 124 extends up a back midline of a wearer's head and partially across an apex of the wearer's head when the inner hood 300 is worn. A terminal edge of the center panel 124 is seamed or affixed to a posterior edge of the mesh elastic panel 314; an anterior edge of the mesh elastic panel 314 is a free edge. The mesh elastic panel 314 is adapted to be positioned across a wearer's forehead when the inner hood 300 is worn. Use of a mesh material allows for breathability and permeability which contributes to wearer comfort, and use of an elastic material facilitates the mesh elastic panel 314 in fitting snugly across the wearer's forehead thus helping to anchor the inner hood 300 to the wearer's head.

In example aspects, the center panel 124 includes the film material 130 (shown in dashed lines to indicate that the film material 130 is affixed to an outer-facing surface of the center panel 124). By configuring the center panel 124, including the film material 130, as described, a continuous zone of low stretch or no stretch material extends from at least the apex of the wearer's head to a lower thoracic or lumbar portion of the wearer's spine which helps to stabilize the wearer's head in a neutral position and helps to prevent the wearer's head from dropping forward when sleeping.

The right panel piece 310 includes a medial edge 318 and a lateral edge 320, and the left panel piece 312 includes a medial edge 322 and a lateral edge 324. The medial edge 318 of the right panel piece 310 and the medial edge 322 of the left panel piece 312 are affixed (e.g., by stitching, bonding, and the like) to the center panel 124. The lateral edge 320 of the right panel piece 310 and the lateral edge 324 of the left panel piece 312 help to form a hood opening for the inner hood 300. In example aspects, each of the lateral edge 320 of the right panel piece 310 and the lateral edge 324 of the left panel piece 312 are substantially unaffixed from the outer hood 116. As used herein, the term "substantially" means that at least about 90% of the respective edges remain unaffixed from the outer hood 116. This helps to decouple the inner hood 300 from the outer hood 116 which, as explained further below, may be beneficial due to the size disparity between the inner hood 300 and the outer hood 116. Each of the right panel piece 310 and the left panel piece 312 may be formed from, for example, a fleece material or a material having a soft hand, and in some example aspects, the material may have stretch and recovery properties achieved using elastic yarns to help the inner hood 300 fit snugly around a wearer's head. In example aspects, side edges of the mesh, elastic panel 314 are affixed to the respective lateral edges 320 and 324 of the right panel piece 310 and the left panel piece 312.

Because of the size disparity between the outer hood 116 and the inner hood 300, coupling the inner hood 300 directly to the outer hood 116 may cause distortion of the outer hood 116 at the coupling points. Having some type of coupling between the outer hood 116 and the inner hood 300, though, may be desirable so that the outer hood 116 and the inner hood 300 can be cooperatively used together. In one example aspect, the center panel 124 may be affixed to the first end 136 and the second end 138 of the opening 134. To further achieve coupling between the inner hood 300 and the outer hood 116 without causing distortion of the outer hood 116, an elastic bridge panel 316 may be used to affix the inner hood 300 to the outer hood 116 at a top of the outer hood 116. The bridge panel 316 is shown in dashed line to indicate it is hidden from view in this particular illustration. For example, the bridge panel 316 may have a first edge affixed to the center panel 124 of the inner hood 300 at an area adjacent to where the center panel 124 is affixed to the mesh elastic panel 314. Alternatively, the first edge of the bridge panel 316 may be affixed to the mesh elastic panel 314. A second opposing edge of the bridge panel 316 is affixed to the outer hood 116 at the top of the outer hood 116. The elastic nature of the bridge panel 316 helps to prevent distortion of the outer hood 116 at the point of connection to the inner hood 300. In example aspects, the connection point between the inner hood 300 and the outer hood 116 is spaced posteriorly from the upper hood opening edge 220 of the outer hood 116. For example, the connection point may be spaced from about 5 cm to about 40 cm from the upper hood opening edge 220 of the outer hood 116. It is contemplated herein that remaining portions of the center panel 124 may remain unaffixed from the outer hood 116.

A lower edge 326 of the inner hood 300 is unaffixed from the neck opening 114 of the torso portion 110. More specifically, the lower edge 326 of the right panel piece 310 and the lower edge 326 of the left panel piece 312 are unaffixed from the neck opening 114 of the torso portion 110. This is due to the size disparity between the inner hood 300 and the outer hood 116. For example, affixing the lower edge 326 of the inner hood 300 to the neck opening 114 would cause buckling and distortion of the lower edge 132 of the outer hood 116. To help secure the lower edge 326 of the inner hood 300, an inner vest 328 is utilized. The inner vest 328 is positioned internal to the torso portion 110 of the upper-body garment 100 and comprises a separate panel piece from the torso portion 110. An upper edge 330 of the inner vest 328 is affixed (e.g., by stitching, bonding, and the like) to the lower edge 326 of each of the right panel piece 310 and the left panel piece 312 of the inner hood 300. The inner vest 328 is also affixed to the first sleeve opening 121 and the second sleeve opening 123 of the torso portion 110. Side edges 332 of the inner vest 328 may be affixed to front edges of the front panels 211*a* and 211*b*. In example aspects, remaining portions of the inner vest 328, such as a bottom edge 333 of the inner vest 328, are unaffixed from the torso portion 110. In example aspects, the bottom edge 333 of the inner vest 328 is spaced superiorly from the waist opening 118 of the torso portion 110 of the upper-body garment 100 (e.g, from about 50 cm to about 300 cm from the waist opening 118 of the torso portion 110). By securing the inner vest 328 to the lower edge 326 of the inner hood 300 and by further securing the inner vest 328 to the first and second sleeve openings 121 and 123 and/or the front edges of the front panels 211*a* and 211*b*, the inner hood 300 is seated and prevented from riding up during wear.

Figure 4:
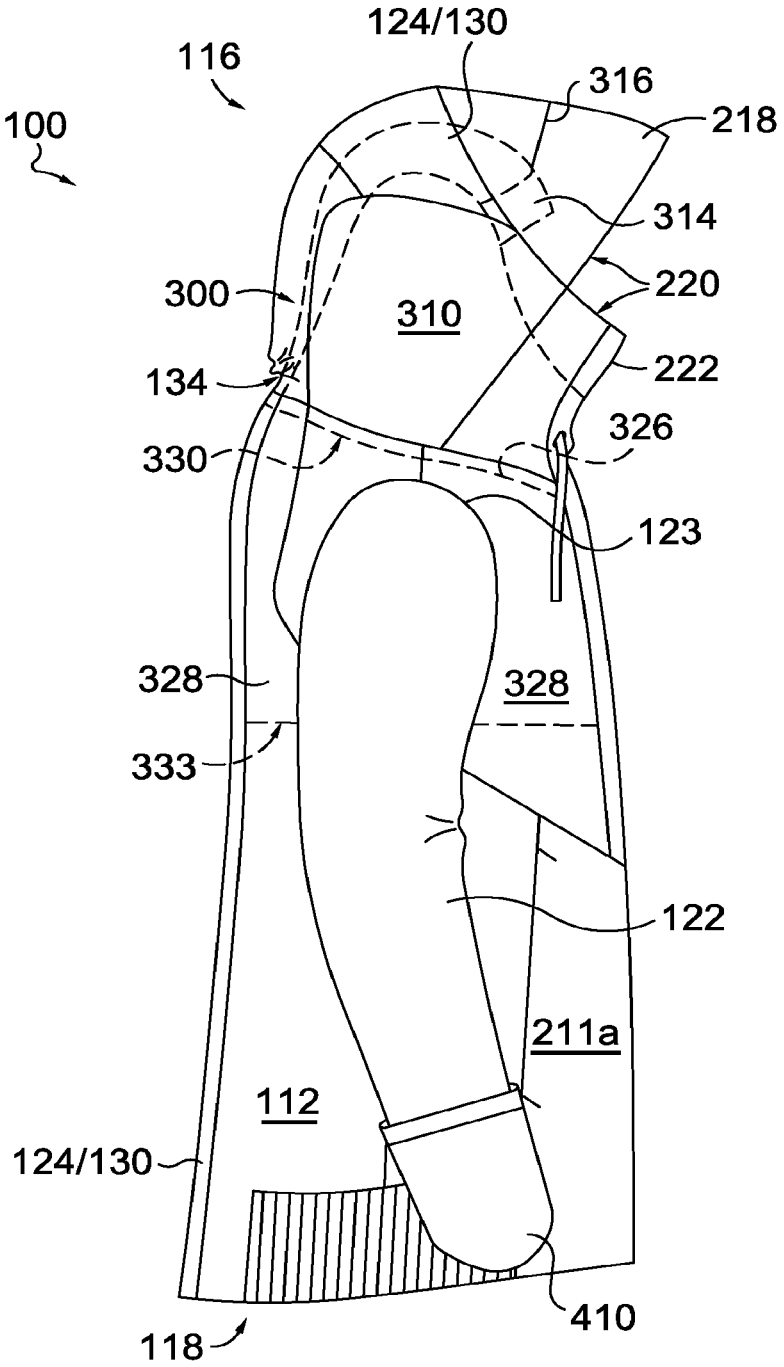
FIG. 4 illustrates a side view of the upper-body garment of FIG. 1 with the inner hood depicted in dashed line in accordance with aspects herein.

FIG. 4 depicts a right-side view of the upper-body garment 100. The upper forward extension 218 of the outer hood 116 is shown extending past an anterior plane of the garment 100. The center panel 124 with the film material 130 affixed thereto extends from the waist opening 118, up the back aspect 112 of the torso portion 110 and through the opening 134 where it forms a central portion of the inner hood 300. FIG. 4 further depicts the mesh elastic panel 314 extending from a terminal edge of the center panel 124. The bridge panel 316 is shown extending from the center panel 124 to the top of the outer hood 116. Also shown is the right panel piece 310 that further forms the inner hood 300. The lower edge 326 of the right panel piece 310 is depicted as affixed to the upper edge 330 of the inner vest 328. Similarly, the lower edge 326 of the left panel piece 312 would be affixed to the upper edge 330 of the inner vest 328. As described above, the inner vest 328 is further affixed to the second sleeve opening 123 and the first sleeve opening 121 (not seen in FIG. 4) and to the front edge of the front panel 211*a* and the front panel 211*b* (not seen in FIG. 4). A left-side view of the upper-body garment 100 would generally be a mirror-image of the view shown in FIG. 4. FIG. 4 depicts an optional mitt 410 that is attached to a distal end of both the first sleeve 120 and the second sleeve 122 and which may be drawn over a wearer's hand when additional warmth is desired.

Figure 5:
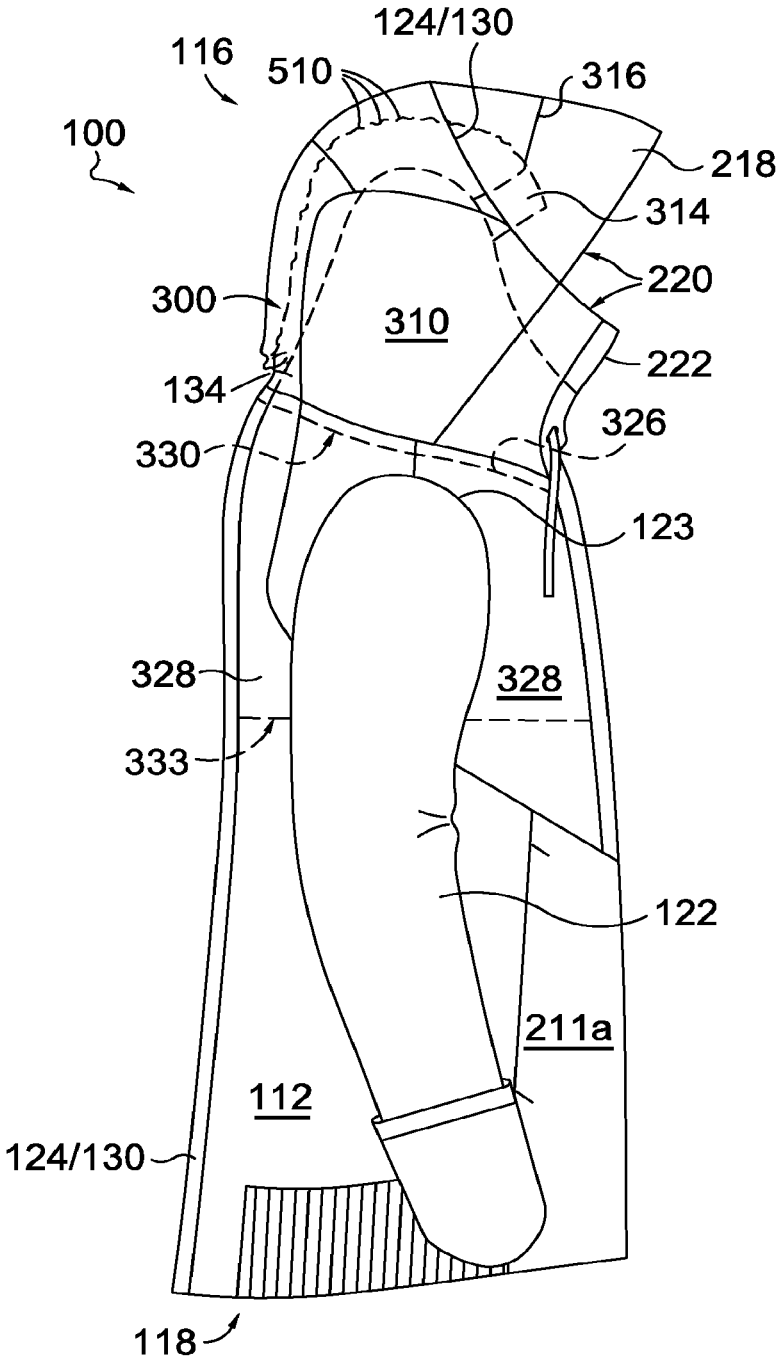
FIG. 5 illustrates a side view of the upper-body garment of FIG. 1 with an alternative inner hood depicted in dashed line in accordance with aspects herein.

FIG. 5 depicts a right-side view of the upper-body garment 100 with an alternative construction for the center panel 124. The same numbers are used to indicate the same structures as in FIG. 4. In the construction shown in FIG. 5, the center panel 124 includes folds 510 at the top of the inner hood 300 and along a portion of the back of the inner hood 300. As explained further below, the folds 510 are formed by cutting the film material 130 to have a shorter length than the center panel 124. The folds 510 cause a shortening of the center panel 124 (i.e., a decrease in length of the center panel 124) which further limits stretch and helps to stabilize the head of a wearer in a neutral position due to the low stretch or no stretch nature of the center panel 124.

Figures 6A, 6B, 6C:
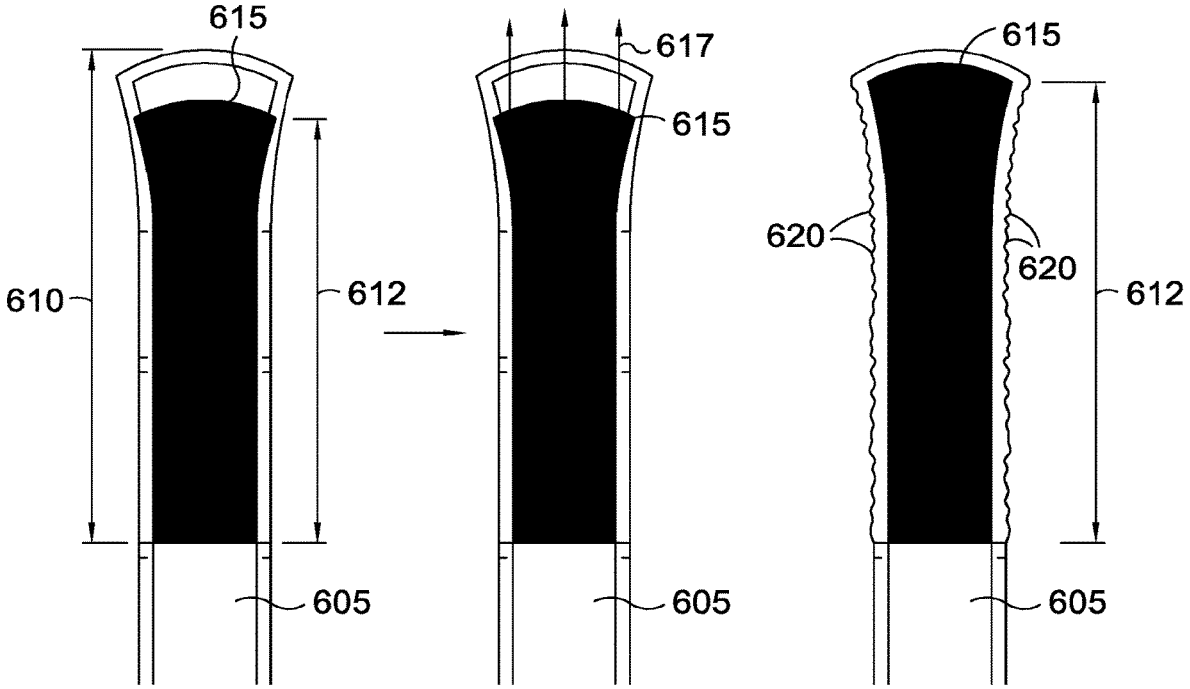
FIGS. 6A-6C illustrate a method of forming a center panel of the inner hood of FIG. 5 in accordance with aspects herein.

FIGS. 6A through 6C illustrate an example construction method for forming the center panel shown in FIG. 5. FIG. 6A depicts an example center panel 605 having a length 610 and an example film material 615 having a length 612; the length 610 of the center panel 605 is measured from a bottom edge of the film material 615 for illustrative purposes. The film material 615 is shown positioned overtop the center panel 605 but not affixed thereto. In example aspects, the length 612 of the film material 615 may be about 2.0 cm less than the length 610 of the center panel 605.

FIG. 6B illustrates the film material 615 being tensioned toward an end of the center panel 605 as indicated by arrows 617. FIG. 6C illustrates the center panel 605 after the film material 615 has been affixed thereto. Because the film material 615 is low stretch, it reverts back to its original length 612 after being stretched and affixed to the center panel 605. This causes the center panel 605 to gather or form a series of folds 620 and to have the length 612. The additional tensioning of the center panel 605 generated by this construction method further helps to stabilize the head of a wearer in a neutral (e.g., upright) or near neutral position when the upper-body garment 100 is worn.

Figure 7:
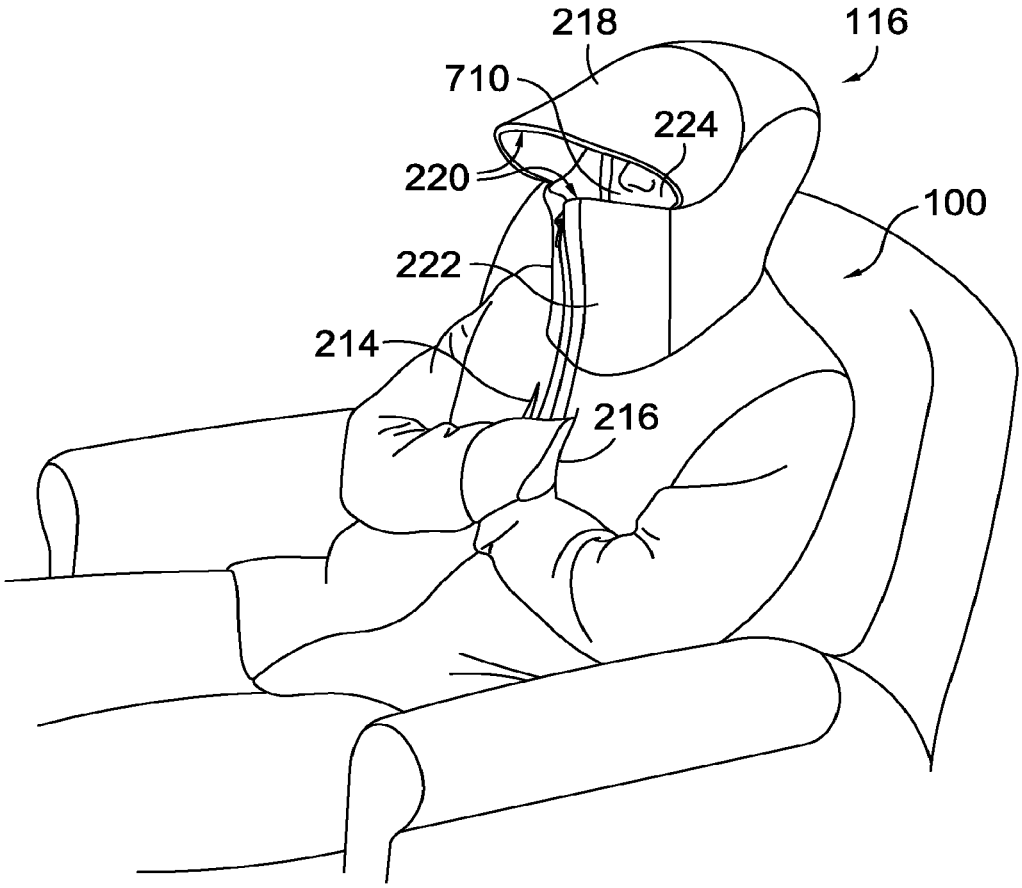
FIG. 7 illustrates a view of the upper-body garment of FIG. 1 being worn by a wearer and helping to facilitate upright sleeping in accordance with aspects herein.

FIG. 7 depicts a wearer 710 wearing the upper-body garment 100 where the upper-body garment 100 is facilitating upright sleeping. In this example, the wearer 710 is seated in a chair located, for example, on a plane, a bus, a car, a seating area, and the like. The outer hood 116 is positioned over the wearer's head, and the upper forward extension 218 is drawn over the wearer's eyes. The upper-body garment 100 is fully closed, and the lower front panel 222 cooperates with the upper forward extension 218 to form the small face opening 224. To further facilitate upright sleeping, the wearer 710 positions his right hand in the second pocket 216 and his left hand in the first pocket 214. Although not shown in this view, the inner hood 300 is positioned snugly and securely around the wearer's head and facilitates keeping the wearer's head in a neutral or nearly neutral position.

Figure 8:
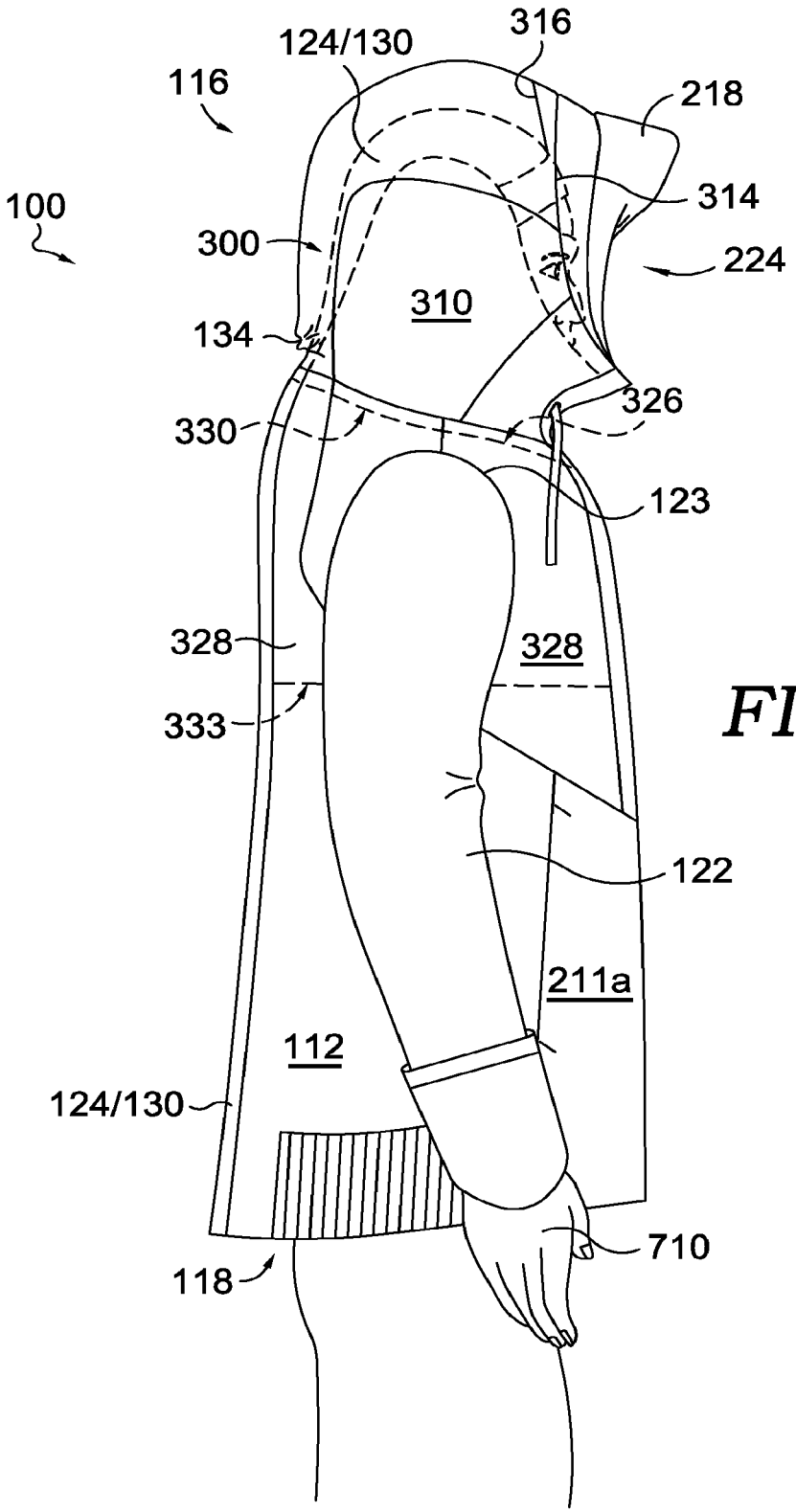
FIG. 8 illustrates a side view of the upper-body garment of FIG. 1 being worn by a wearer in accordance with aspects herein.

FIG. 8 depicts the upper-body garment 100 being worn by the wearer 710 while the wearer 710 is standing and is provided to illustrate how the inner hood 300 is positioned around the wearer's head. As shown, the mesh elastic panel 314 is positioned across the wearer's forehead. The center panel 124 with the film material 130 affixed thereto, extends from the mesh elastic panel 314 over the top and back of the wearer's head before exiting the opening 134 and continuing to extend down the back aspect 112 of the torso portion 110 to terminate at the waist opening 118. The right panel piece 310 covers the right side of the wearer's head including, for example, the wearer's right ear. The left panel piece 312 would similarly cover the left side of the wearer's head including the wearer's left ear. The lower edge 326 of the right panel piece 310 is affixed to the upper edge 330 of the inner vest 328 to help secure and seat the inner hood 300 on the wearer's head. Similarly, the lower edge 326 of the left panel piece 312 is also affixed to the upper edge 330 of the inner vest 328. The upper forward extension 218 is shown rolled back so that the face opening 224 is larger and the wearer 710 has better external viewing.

Figure 9:
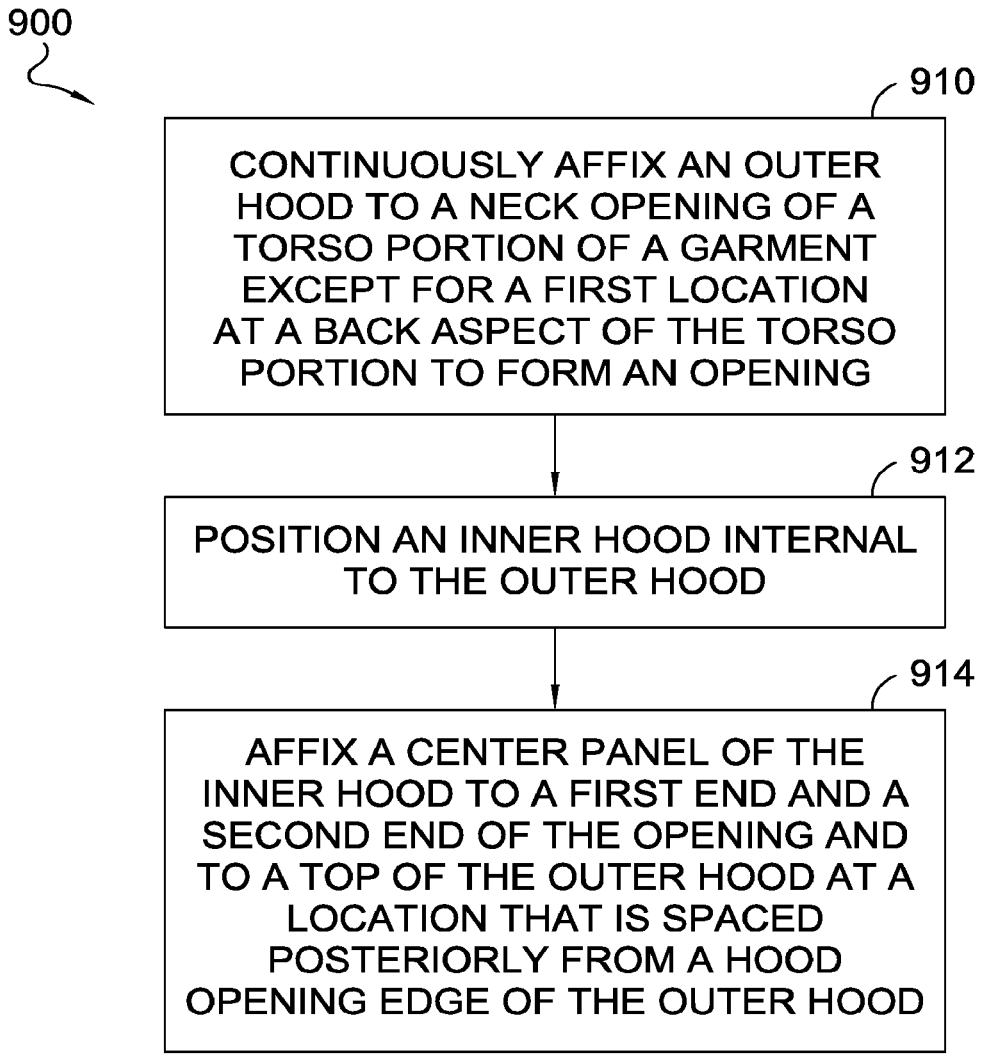
FIG. 9 illustrates a flow diagram of an example method of manufacturing an upper-body garment for upright sleeping in accordance with aspects herein.

FIG. 9 illustrates a flow diagram of an example method 900 of manufacturing an upper-body garment, such as the upper-body garment 100 that facilitates upright sleeping. At a step 910, an outer hood, such as the outer hood 116, is continuously affixed to a neck opening of a torso portion of the upper-body garment except for a first location at the back aspect of the torso portion to form an opening such as the opening 134. At a step 912, an inner hood, such as the inner hood 300, is positioned internal to the outer hood. At a step 914, a center panel, such as the center panel 124, of the inner hood is affixed to a first end and a second end, such as the first end 136 and the second end 138, of the opening and to a top of the outer hood at a location that is spaced posteriorly from a hood opening edge of the outer hood. Additional steps may include affixing a low stretch or no stretch film material to the center panel to further limit the stretch of the center panel. In some example aspects, it is contemplated that the film material may be cut to have a shorter length than the center panel. The film material is then tensioned in a longitudinal direction before being affixed to the center panel. This causes a gathering of the center panel when the film material reverts to its resting length. In turn, this may further limit the stretch of the center panel and further facilitate the center panel helping to maintain a wearer's head in a neutral or upright position.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. An upper-body garment comprising:

a torso portion defining a neck opening and a waist opening, the torso portion having a front aspect and a back aspect;

an outer hood affixed to the neck opening at both a first end and a second end of an unaffixed portion of the outer hood to form a rear opening, wherein the rear opening is located at the back aspect of the torso portion; and an inner hood positioned internal to the outer hood, a center panel of the inner hood affixed to the outer hood at the first end and the second end of the unaffixed portion of the outer hood, the center panel of the inner hood further affixed directly to an apex of the outer hood when the upper-body garment is in an upright orientation; and wherein the center panel of the inner hood extends through the rear opening and forms at least a portion of the back aspect of the torso portion, and wherein the center panel is formed from a low stretch or no stretch material.

2. The upper-body garment of claim 1, wherein the center panel includes a low stretch or no stretch film material affixed to a first surface of the center panel.

3. The upper-body garment of claim 1, wherein the center panel of the inner hood is affixed to the apex of the outer hood at a location that is spaced posteriorly from a hood opening edge of the outer hood.

4. The upper-body garment of claim 1, wherein the inner hood further includes a right panel and a left panel, each of the right panel and the left panel having a medial edge, a lateral edge, and a lower edge.

5. The upper-body garment of claim 4, wherein the medial edge of each of the right panel and the left panel are affixed to the center panel.

6. The upper-body garment of claim 5, wherein the lateral edge of each of the right panel and the left panel are substantially unaffixed from the outer hood.

7. The upper-body garment of claim 6, wherein the lower edge of each of the right panel and the left panel are unaffixed from the neck opening of the torso portion.

8. An upper-body garment comprising:

a torso portion defining a neck opening and a waist opening, the torso portion having a front aspect and a back aspect, wherein the back aspect includes a center panel;

an outer hood continuously affixed to the neck opening except for a first location at the back aspect of the torso portion to form a rear opening; and an inner hood positioned internal to the outer hood, wherein the center panel of the back aspect of the torso portion extends through the opening and forms at least part of the inner hood, and wherein the center panel is further affixed directly to an apex of the outer hood at a location that is spaced posteriorly from a hood opening edge of the outer hood when the upper-body garment is in an upright orientation, wherein the inner hood includes a right panel and a left panel, each of the right panel and the left panel having a medial edge, a lateral edge, and a lower edge.

9. The upper-body garment of claim 8, wherein the center panel is further affixed to a first end and a second end of the rear opening.

10. The upper-body garment of claim 9, wherein remaining areas of the center panel are unaffixed from the outer hood.

11. The upper-body garment of claim 8, wherein the center panel extends to the waist opening of the torso portion.

12. The upper-body garment of claim 8, wherein the medial edge of each of the right panel and the left panel are affixed to the center panel.

13. The upper-body garment of claim 12, wherein the lateral edge of each of the right panel and the left panel are substantially unaffixed from the outer hood.

14. The upper-body garment of claim 13, wherein the lower edge of each of the right panel and the left panel are unaffixed from the neck opening of the torso portion.

15. A method of manufacturing an upper-body garment having a torso portion with a neck opening and a waist opening, the torso portion having a front aspect and a back aspect, the back aspect including a center panel, the method comprising:

continuously affixing an outer hood to the neck opening of the torso portion except for a first location at the back aspect of the torso portion to form a rear opening;

positioning an inner hood internal to the outer hood, wherein the center panel of the back aspect extends through the rear opening and forms at least part of the inner hood, wherein the inner hood includes a right panel and a left panel, each of the right panel and the left panel having a medial edge, a lateral edge, and a lower edge; and affixing the center panel to a first end and a second end of the rear opening and directly to an apex of the outer hood at a location that is spaced posteriorly from a hood opening edge of the outer hood when the upper-body garment is in an upright orientation.

16. The method of manufacturing the upper-body garment having the torso portion with the neck opening and the waist opening of claim 15, further comprising affixing a low stretch or no stretch film material to a first surface of the center panel.

* * * * *